US008992255B2

(12) United States Patent
Chang

(10) Patent No.: US 8,992,255 B2
(45) Date of Patent: Mar. 31, 2015

(54) CONNECTOR RECEPTACLE

(71) Applicant: Advanced-Connectek Inc., New Taipei (TW)

(72) Inventor: Ming-Young Chang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 145 days.

(21) Appl. No.: 13/770,248

(22) Filed: Feb. 19, 2013

(65) Prior Publication Data

US 2014/0099832 A1 Apr. 10, 2014

(30) Foreign Application Priority Data

Oct. 4, 2012 (TW) ..... 1101219237

(51) Int. Cl.

| | |
|---|---|
| ***H01R 24/00*** | (2011.01) |
| ***H01R 13/516*** | (2006.01) |
| ***H01R 13/6581*** | (2011.01) |
| ***H01R 13/6593*** | (2011.01) |

(52) U.S. Cl.

CPC ..... *H01R 13/516* (2013.01); *H01R 13/6581* (2013.01); *H01R 13/6593* (2013.01)

USPC ..... 439/607.23; 439/630

(58) Field of Classification Search

CPC ..... H01R 13/6593; H01R 12/707; H01R 13/502; H01R 13/6581

USPC ..... 439/607.4, 23, 28, 35

See application file for complete search history.

(56) References Cited

U.S. PATENT DOCUMENTS

| | | | | |
|---|---|---|---|---|
| 6,685,508 | B2 * | 2/2004 | Zhu et al. | 439/607.23 |
| 7,217,159 | B2 * | 5/2007 | Chung | 439/607.01 |
| 7,922,535 | B1 * | 4/2011 | Jiang et al. | 439/607.35 |
| 8,535,099 | B1 * | 9/2013 | Lin | 439/607.4 |
| 2003/0119347 | A1 * | 6/2003 | Kubo | 439/100 |
| 2009/0325417 | A1 * | 12/2009 | Ko | 439/350 |
| 2012/0040540 | A1 * | 2/2012 | Lee et al. | 439/65 |
| 2012/0052697 | A1 * | 3/2012 | Yu | 439/55 |
| 2013/0023154 | A1 * | 1/2013 | Ii | 439/607.5 |
| 2014/0045376 | A1 * | 2/2014 | Hsu et al. | 439/607.28 |

* cited by examiner

*Primary Examiner* — Truc Nguyen

(74) *Attorney, Agent, or Firm* — Rabin & Berdo, P.C.

(57) ABSTRACT

A connector receptacle includes an insulation body defining a plurality of terminal slots formed thereon, multiple terminals securely received in the plurality of terminal slots of the insulation body and a metal shell which covers the insulation body and includes an upper metal shell and a lower metal shell wherein the lower metal shell is connected to the upper metal shell via a connection portion which is formed on corresponding sides of the upper metal shell and of the lower metal shell.

8 Claims, 7 Drawing Sheets

CONNECTOR RECEPTACLE

CROSS-REFERENCE TO RELATED APPLICATION

This application claims priority from application No 101219237, filed on Oct. 4, 2012 in the Taiwan Intellectual Property Office.

FIELD OF THE INVENTION

The invention relates to a connector receptacle, and more particularly to a one-piece metal shell of the connector receptacle which includes an upper metal shell and a lower metal shell and is made from a single mold for low manufacturing cost and ease of processing.

BACKGROUND OF THE INVENTION

As USB (Universal Series Bus) connector has plug-in feature and fast transmission speed, it has been widely used in all kinds of information transmission media. Also, following the advances of modern technology, requirements in information transmission speed and stability are drastically increased.

Currently, USB 2.0 is the mainstream for data transmission. However, due to the large data volume and fast transmission speed requirements, performance and characteristics of USB 2.0 no longer satisfy the general needs. Changes and upgrades to the currently available USB 2.0 has become an issue to be solved by the industry. As a solution to the problem the USB 2.0 has, a new product called USB 3.0 is produced to the market, which transcends all the characteristics the old USB 2.0 has and has features such as low power consumption, high coordination efficiency and large transmission speed, up to 5 Gbps compared to 480 Mbps of the conventional transmission speed.

All the USBs require some kind of protection for the fragile terminals. For that, a metallic casing is developed to protect the terminals and block noises affecting the terminals. Conventional method includes production of an integral metallic body and production of a two-part metallic body.

With reference to FIG. 1, a conventional connector receptacle 1 is shown and composed of an insulation body 11 having a plurality of terminal slots 12 formed thereon, a plurality of terminals 13 to be received in the plurality of terminal slots 12 of the insulation body 11 and a metal shell 14 covering the insulation body 11 to reducing interferences from the environment. The metal shell 14 has through holes 15 defined in a side face thereof to form soldering legs 16 on a side face of the metal shell 14. The soldering legs 16 are formed for combination with a printed circuit board in future process. Therefore, it is necessary to have the soldering legs 16. However, due to the process requirement for the soldering legs 16, the integrity of the overall metal shell 14 is damaged and thus the durability of the metal shell 14 is also decreased.

In order to overcome the aforementioned durability and integrity problems, a different metal shell is introduced to the market. The metal shell is composed of two halves each having multiple soldering legs formed on an edge thereof. Each half of the metal shell is uniquely formed in a different mold so that after the two halves are formed, a combination process is necessary to combine the two halves to form the metal shell. Even though, the durability and integrity of the metal shell are maintained, an additional combination process for the two halves is added. Furthermore, due to the two molds for each of the unique halves of the metal shell, the manufacture cost is increased.

SUMMARY OF THE INVENTION

The primary objective of the present invention is to provide a metal shell of a connector receptacle including two-piece portion, for example an upper metal shell and a lower metal shell, that are made from the identical mold so that not only the integrity of the metal shell is maintained, the manufacturing cost is also low.

In order to accomplish the aforementioned objective, the connector receptacle constructed in accordance with the present invention includes an insulation body defining a plurality of terminal slots thereon, multiple terminals securely received in the plurality of terminal slots of the insulation body, and a metal shell which covers the insulation body and includes an upper metal shell and a lower metal shell wherein the lower metal shell is connected to the upper metal shell via a connection portion.

In a preferred embodiment, the connection portion is formed on two corresponding sides of the upper metal shell and of the lower metal shell.

In a preferred embodiment, the connection portion is formed on a selected left side and a right side of the upper metal shell and of the lower metal shell.

In still another embodiment of the present invention, the connection portion is deformable so as to combine the upper metal shell and the lower metal shell.

In another embodiment of the present invention, the connection portion includes a fixing element and a supporting element receiving the deformed fixing element to complete the combination of the upper metal shell and the lower metal shell.

Still, in another embodiment of the present invention, multiple soldering legs are formed on an edge of the metal shell.

The connector receptacle is a Micro USB connector receptacle.

DETAILED DESCRIPTION OF THE INVENTION

Figure 1:
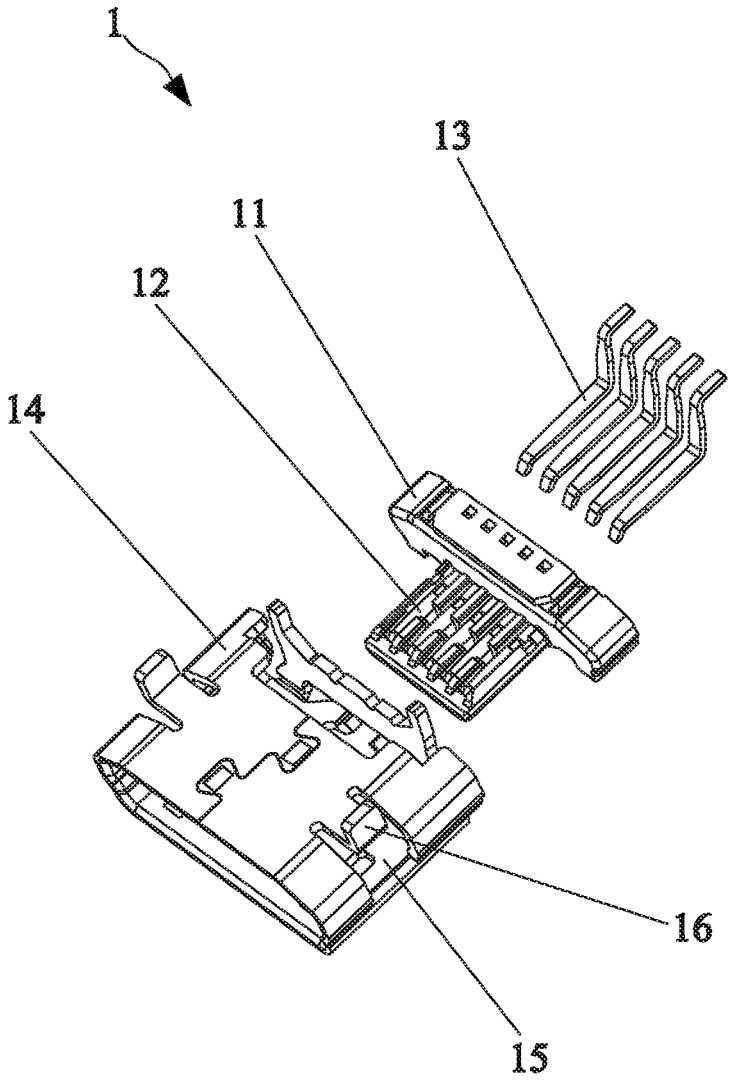
Fig. 1 Prior Art
FIG. 1 is an exploded perspective view showing a conventional connector.
Figure 2:
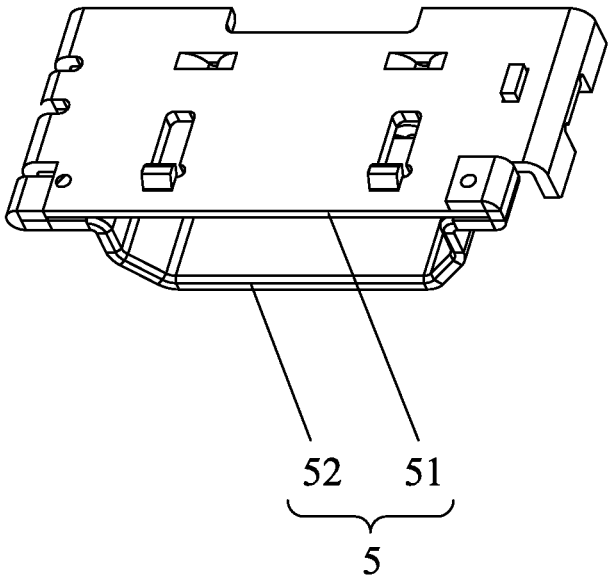
FIG. 2 is perspective view showing a preferred embodiment of the connector receptacle of the present invention.
Figure 3:
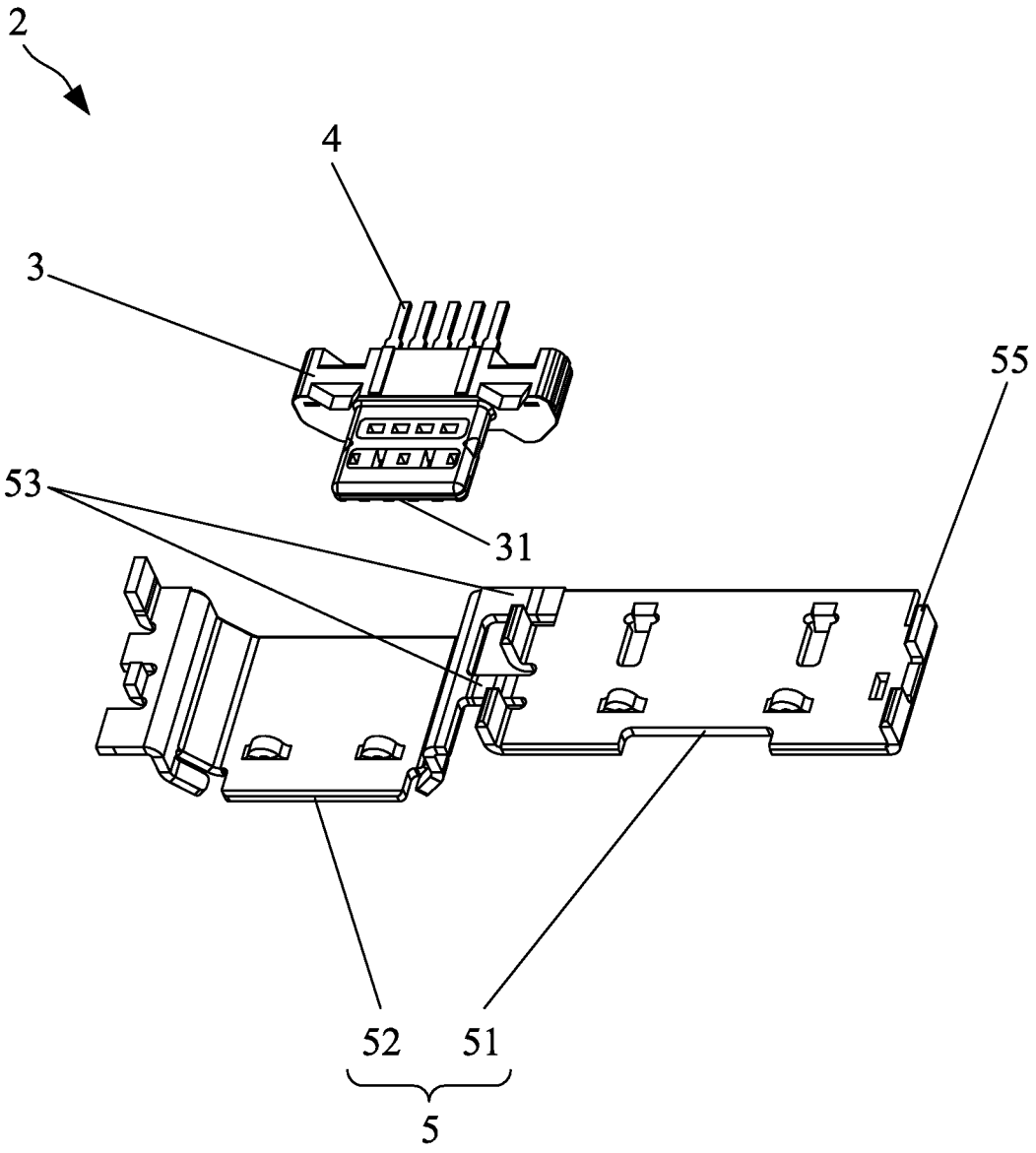
FIG. 3 is a perspective view showing the connector receptacle of the present invention is displayed for receiving therein the insulation body and terminals.
Figure 4:
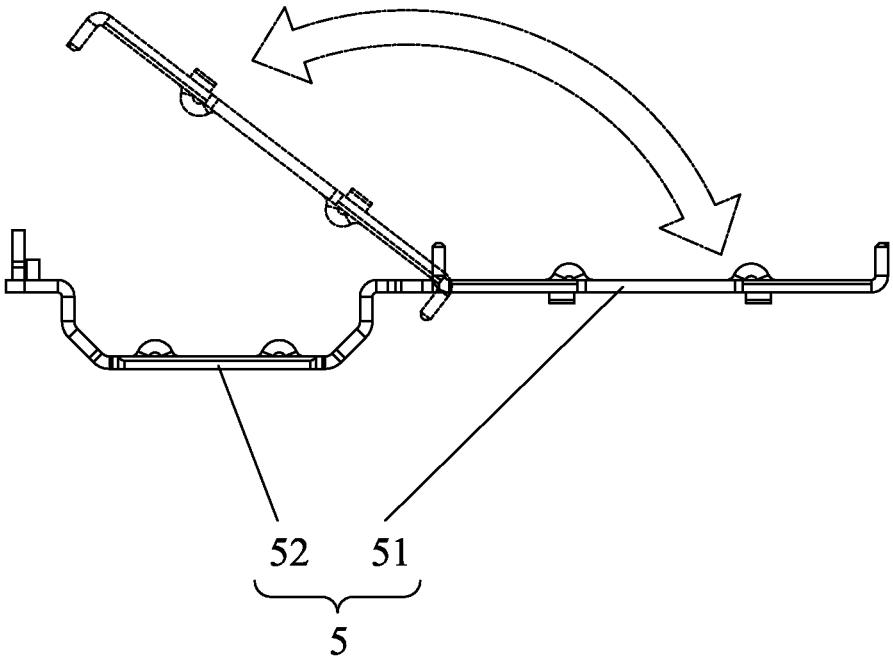
FIG. 4 is a schematic view showing the application of the connector receptacle of the present invention.
Figure 5:
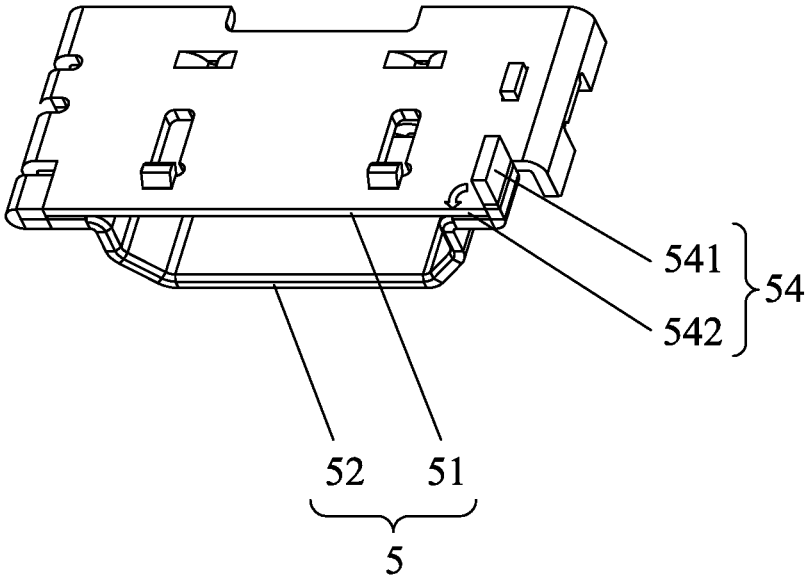
FIG. 5 is still another schematic view showing the application of the pressing part of the connector receptacle of the present invention.
Figure 6:
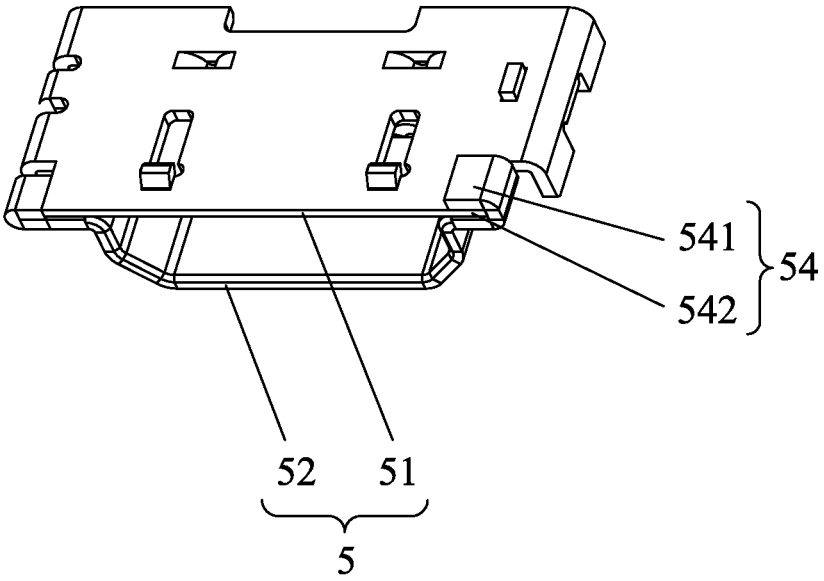
FIG. 6 is a perspective view showing that the pressing part is depressed.

With reference to FIGS. 2 and 3, a Micro USB connector 2 constructed in accordance with the present invention includes an insulation body 3 defining a plurality of terminal slots 31 thereon, multiple terminals 4 securely received in the plurality of terminal slots 31, and a metal shell 5.

The metal shell 5 covering the insulation body 3 includes an upper metal shell 51 and a lower metal shell 52 pivotally connected to the upper metal shell 51 via a deformable and bendable connection portion 53. The connection portion 53 is formed on a side face of each of the upper metal shell 51 and the lower metal shell 52. Preferably, the connection portion 53 is formed on a left side of the upper metal shell 51 and a corresponding right side of the lower metal shell 52, which corresponds to the left side of the upper metal shell 51. That is, the connection portion 53 is formed on a selected one of the left side and the right side of the upper metal shell 51 and the lower metal shell 52. Still preferably the connection portion 53 is formed on a selected one of an upper side and a lower side of the upper metal shell 51 and the lower metal shell 52. From the depiction of the accompanying drawings, it is noted that there are two connection portions 53 formed between the upper metal shell 51 and the lower metal shell 52.

The connection portion 53 is bendable so that the upper metal shell 51 is rotatable from a first position to a second position. The metal shell 5 is open and the upper metal shell 51 is adjacent to the lower metal shell 52 when the upper metal shell 51 is at the first position, and the metal shell 5 is closed and the upper metal shell 51 is disposed on top of the lower metal shell 52 when the upper metal shell 51 is at the second position.

Preferably, there are multiple soldering legs 55 formed on a side face of the metal shell 5 for engagement with a printed circuit board (not shown).

With reference to FIGS. 3, 4, 5 and 6, it is noted that the connection portion 53 connects the lower metal shell 52 to the upper metal shell 51. When combination of the upper metal shell 51 and the lower metal shell 52 is necessary, the connection portion 53 is bent to allow the upper metal shell 51 to be rotated on top of the lower metal shell 52. The connector receptacle of the preferred embodiment of the present invention further has a combination means 54 formed between the upper metal shell 51 and the lower metal shell 52. The combination means 54 comprises a fixing element 541 and a supporting element 542. The supporting element 542 is formed on the upper metal shell 51 and the fixing element 541 is formed on the lower metal shell 52 such that when the combination of the upper metal shell 51 and the lower metal shell 52 is necessary, the fixing element 541 is deformed (bent) toward the supporting element 542 to complete the combination. Even though, the combination means 54 is described, there are modifications, alternations and other changes originally motivated by the concept of the embodiments of the present invention should also be included in the scope of protection.

It is also noted that the bent of the fixing element 541 is able to be completed while the lower metal shell 52 is still in the manufacture mold. As a result of this feature, the manufacturing cost for extra manpower to complete the assembly of the upper metal shell 51 and the lower metal shell 52 is low.

Figure 7:
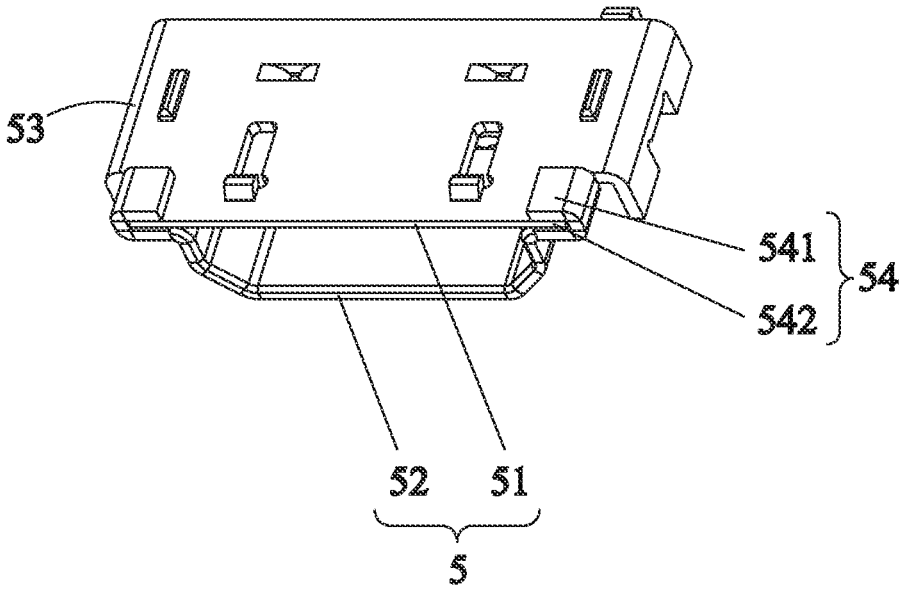
FIG. 7 is a perspective view showing another preferred embodiment of the connector receptacle of the present invention.

With reference to FIG. 7, another embodiment of the present invention is shown, wherein this embodiment is substantially the same as the embodiment shown previously. The difference therebetween is that there is only one connection portion 53. Also, there are two combination means 54 on the corresponding sides of the upper metal shell 51 and the lower metal shell 52. Each combination means 54 includes a fixing element 541 and a supporting member 542. After the fixing element 541 is pressed forward the supporting member 542, the combination of the upper metal shell 51 and the lower metal shell 542 is completed.

From the above description, it is noted that the present invention has the following advantages:

Only one mold is required.

Combination between the upper metal shell and the lower metal shell can be completed while the metal shells are still in the mold. Manufacture cost is greatly reduced.

Multiple soldering legs increase the overall durability.

What is claimed is:

1. A connector receptacle, comprising:

an insulation body defining a plurality of terminal slots formed thereon;

multiple terminals securely received in the terminal slots of the insulation body; and a metal shell covering the insulation body and comprising: an upper metal shell; and a lower metal shell pivotally connected to the upper metal shell via a connection portion which is formed on the corresponding sides of the upper metal shell and of the lower metal shell, wherein the connection portion is bendable so that the upper metal shell is rotatable from a first position to a second position, and wherein when the upper metal shell is in the first position, the metal shell is open and the upper metal shell is adjacent to the lower metal shell, and wherein when the upper metal shell is in the second position, the metal shell is closed and the upper metal shell is disposed on top of the lower metal shell.

2. The connector receptacle as claimed in claim 1, wherein the connection portion is formed on a selected one of a left side and a right side of the upper metal shell and of the lower metal shell.

3. The connector receptacle as claimed in claim 1, wherein the connection portion is formed on a selected one of a front side and a rear side of the upper metal shell and of the lower metal shell.

4. The connector receptacle as claimed in claim 1 further comprising a combination means formed on the corresponding sides of the upper metal shell and of the lower metal shell such that the upper metal shell is combined with the lower metal shell.

5. The connector receptacle as claimed in claim 4, wherein the combination means comprising a supporting member and a fixing element deformable toward the supporting member to complete the combination of the upper metal shell and the lower metal shell.

6. The connector receptacle as claimed in claim 1 further comprising multiple soldering legs formed on a side face of the metal shell.

7. The connector receptacle as claimed in claim 1 being a Micro USB connector receptacle.

8. The connector receptacle as claimed in claim 1, wherein the upper metal shell, the lower metal shell and the connection portion form a single and integral unit.

* * * * *